US005924325A

United States Patent [19]

Brücher et al.

[11] Patent Number: 5,924,325

[45] Date of Patent: Jul. 20, 1999

[54] LIFTING DEVICE, FOR EXAMPLE, FOR TAPHOLE DRILLING MACHINES OR SPLASH COVER MANIPULATORS

[75] Inventors: Eberhard Brücher; Wolfgang Klaas, both of Siegen, Germany

[73] Assignee: Dango & Dienenthal Maschinenbau GmbH, Siegen, Germany

[21] Appl. No.: 08/901,695

[22] Filed: Jul. 28, 1997

[30] Foreign Application Priority Data

Jul. 26, 1996 [DE] Germany ..... 196 30 078

[51] Int. Cl.[6] ..... C21C 5/46; B66C 23/00; F16H 21/44

[52] U.S. Cl. ..... 74/106; 74/105; 74/110; 414/680; 414/917; 266/272

[58] Field of Search ..... 74/105, 106, 110; 414/917, 729, 680; 266/271, 272

[56] References Cited

U.S. PATENT DOCUMENTS

| | | | |
|---|---|---|---|
| 2,181,881 | 12/1939 | Ferris | 414/680 |
| 2,317,852 | 4/1943 | Fullerton | 414/680 |
| 4,057,234 | 11/1977 | Brucher et al. | 266/272 |
| 5,704,569 | 1/1998 | Daniels | 74/105 |

FOREIGN PATENT DOCUMENTS

| | | | |
|---|---|---|---|
| 2630232 | 7/1977 | Germany | 266/271 |
| 3614-720 | 11/1987 | Germany | 414/917 |
| 89-234691/33 | 3/1989 | Germany | 266/271 |
| 137940 | of 1961 | U.S.S.R. | 266/271 |
| 386994 | 6/1973 | U.S.S.R. | 266/271 |
| 505679 | 7/1976 | U.S.S.R. | 266/272 |
| 92-046638/06 | 3/1991 | U.S.S.R. | 266/271 |

*Primary Examiner*—John A. Jeffery
*Assistant Examiner*—William C Joyce
*Attorney, Agent, or Firm*—Young & Thompson

[57] ABSTRACT

In machines for opening of a tapping hole, for example in tapping hole boring machines, carriage holder (4) with boring bar and boring machine is swung up via four-bar linkage (5) by a lifting cylinder (10) out of an optionally obliquely sloped working or boring position into a neutral position out of the area of a runner. The boring angle is adjustable on connecting rod (7) of four-bar linkage (5). To securely keep the lifting device for automatic changing of the boring bar always in the horizontal neutral position, piston rod (11) of lifting cylinder (10) is linked to the free end of angle lever (13) which is pivoted around axis (16) located stationary on lifting frame (8). The angle lever is hinged via link plate (14) to upper short lever arm (15) of lifting arm (6). Link plate (14) with short lever arm (15) and angle lever (13) in the horizontal neutral position of the lifting device forms self-locking knee link (18). To adjust the working or boring angle, one of joints (22, 23) of connecting rod (7) is adjustable on an arc with a center of curvature which coincides with the axis of the other of joints (22, 23) of connecting rod (7) at the time, when the lifting device is in the neutral position.

9 Claims, 5 Drawing Sheets

1
2
3
4
5
6
7
8
9

10
11
28
27
17
16
23
18
25
14
19
4
20
6
22
21
26
29

LIFTING DEVICE, FOR EXAMPLE, FOR TAPHOLE DRILLING MACHINES OR SPLASH COVER MANIPULATORS

FIELD OF THE INVENTION

The invention relates to a lifting device for machines for opening of tapping holes or hood manipulators.

BACKGROUND OF THE INVENTION

Since the lever kinematics of the two lifting devices is identical, and only the machine part to be lifted is different, specifically machines for opening of tapping holes, or hood manipulators, the lifting system is described below only with reference to machines for opening of tapping holes.

After opening the tapping hole of a metallurgical furnace, the carriage with the tool, for example, the boring bar, must be moved as quickly as possible out of its working position via the runner away from the liquid metal stream flowing out of the furnace, in order not to be damaged by the liquid metal.

Nevertheless, the tool must be changed frequently due to wear. For this reason a bar changer is often available which as a robot removes the used tool, hereinafter called the boring bar, and inserts a new boring bar into the carriage from a storage magazine. To do this it is necessary that the carriage with the boring bar assume a neutral position which is always uniform and horizontal so that the bar changer can engage correctly.

Known lifting devices in which the angle of incline of the working position can be set do not satisfy these conditions for automatic boring bar changing, since an altered boring angle also causes an altered neutral position.

SUMMARY OF THE INVENTION

The object of the invention is to devise a lifting device for tapping hole boring machines in which, regardless of the set angle of incline of the boring bar for the boring position, the boring bar in the neutral position always assumes a horizontal position and the entire lifting device is held securely in the neutral position.

This object is achieved as claimed in the invention by the characterizing features of the independent claims, feasible developments of the invention being identified in the respective subclaims.

The two embodiments identified in the claims, besides ensuring the same horizontal position of the boring bar in the neutral position of the tapping hole boring machine, have other important advantages. The special transfer of the force of the lifting cylinder via an angle lever and a link plate to the short lever arm of the lifting arm makes it possible to move the link plate and the short lever arm in the form of a knee link into a locking position so that the entire lifting device is reliably held in the neutral position independently of the hydraulic pressure in the lifting cylinder, even if the latter were to become depressurized or even dismounted. In this way the horizontal neutral position of the boring bar is ensured so that it can be automatically changed without difficulty.

The special arrangement of the levers and link plate allows the lifting motion out of the boring position to proceed initially very quickly, which is very important for the service life of the boring bar, and is reduced almost to zero towards the neutral position so that when the neutral position is reached there are hardly any vibrations which in the past with the relatively high weight of the tapping hole boring machine required an especially strong design of the suspension on the pivot mounting for swivelling away on a circular path, so that in this respect a lighter construction is possible.

In the first embodiment, which is used in particular where there is enough space to the top, the horizontal position of the boring bar in the neutral position of the tapping hole boring machine is not changed by any setting of the boring angle (within a stipulated range) in the slot rocker.

This also applies to the second embodiment, which is used where the space to the top is limited, for example by a gallery, in this case the adjustment of the boring angle taking place on a tilt cylinder which replaces the connecting rod of the first embodiment by adjustably limiting its stroke in the direction to the boring position. The height of the boring position is fixed in the same way on the lifting cylinder in this second embodiment.

BRIEF DESCRIPTION OF THE DRAWINGS

Other advantages of the lifting device according to the invention become apparent from the following description with reference to the drawings.

DESCRIPTION OF THE PREFERRED EMBODIMENTS

Figure 1:
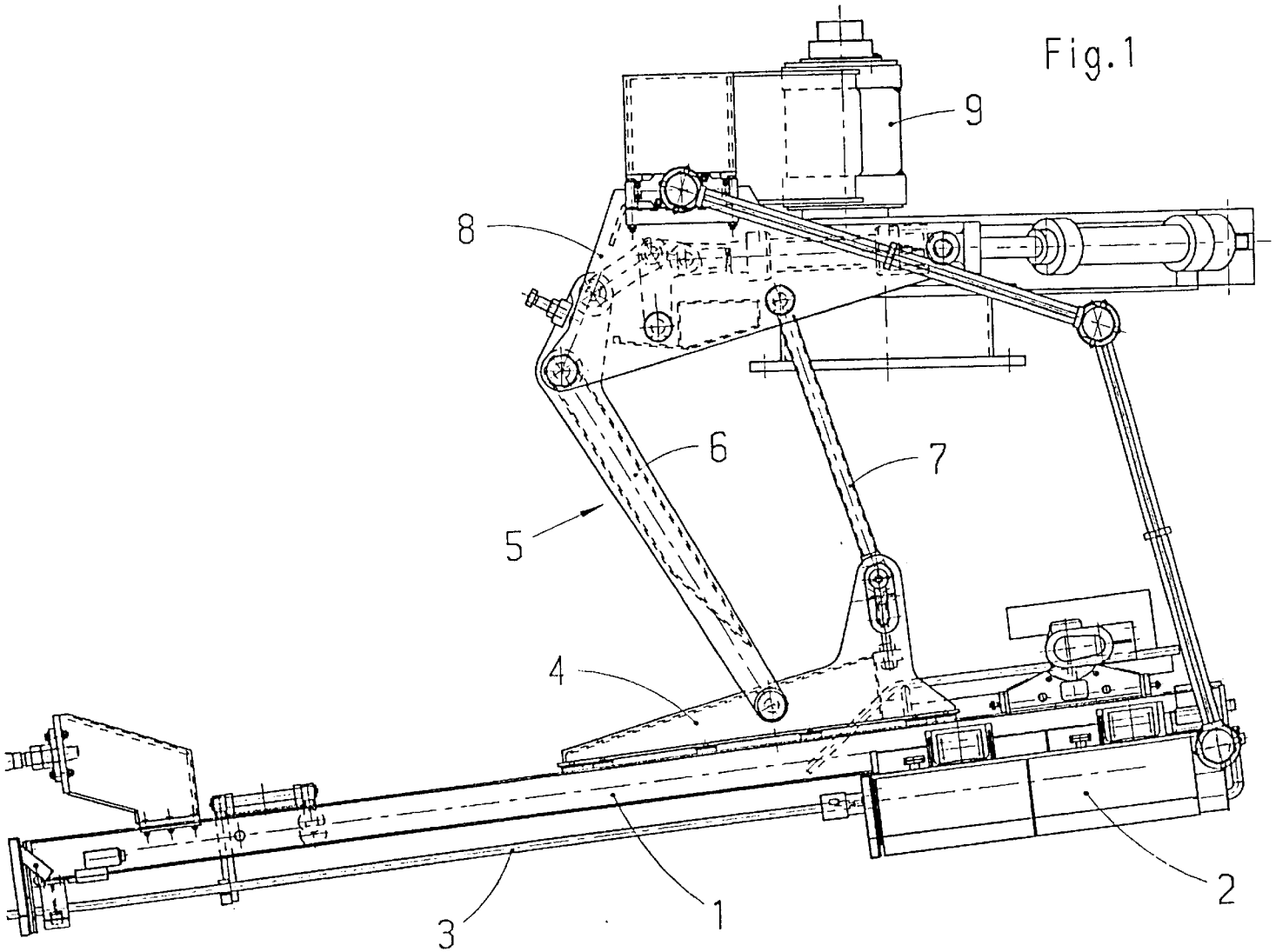
FIG. 1 shows a side view of a tapping hole boring machine with the first embodiment of the lifting device in the boring position.

FIG. 1 shows in a side view a tapping hole boring machine in the boring position. It consists essentially of boring carriage 1 for holding boring machine 2 with boring bar 3, carriage holder 4 and four-bar linkage 5 with lifting arm 6 and connecting rod 7. Four-bar linkage 5 joins carriage holder 4 to swivel with lifting frame 8 which sits on pivot mounting 9 to swivel around a vertical axis via an extension arm (not shown). Four-bar linkage 5 together with lifting cylinder 10 forms a lifting device which is shown for itself in FIGS. 2 and 3 in the boring position or neutral position and which operates in a manner to be described using these Figures.

Figure 2:
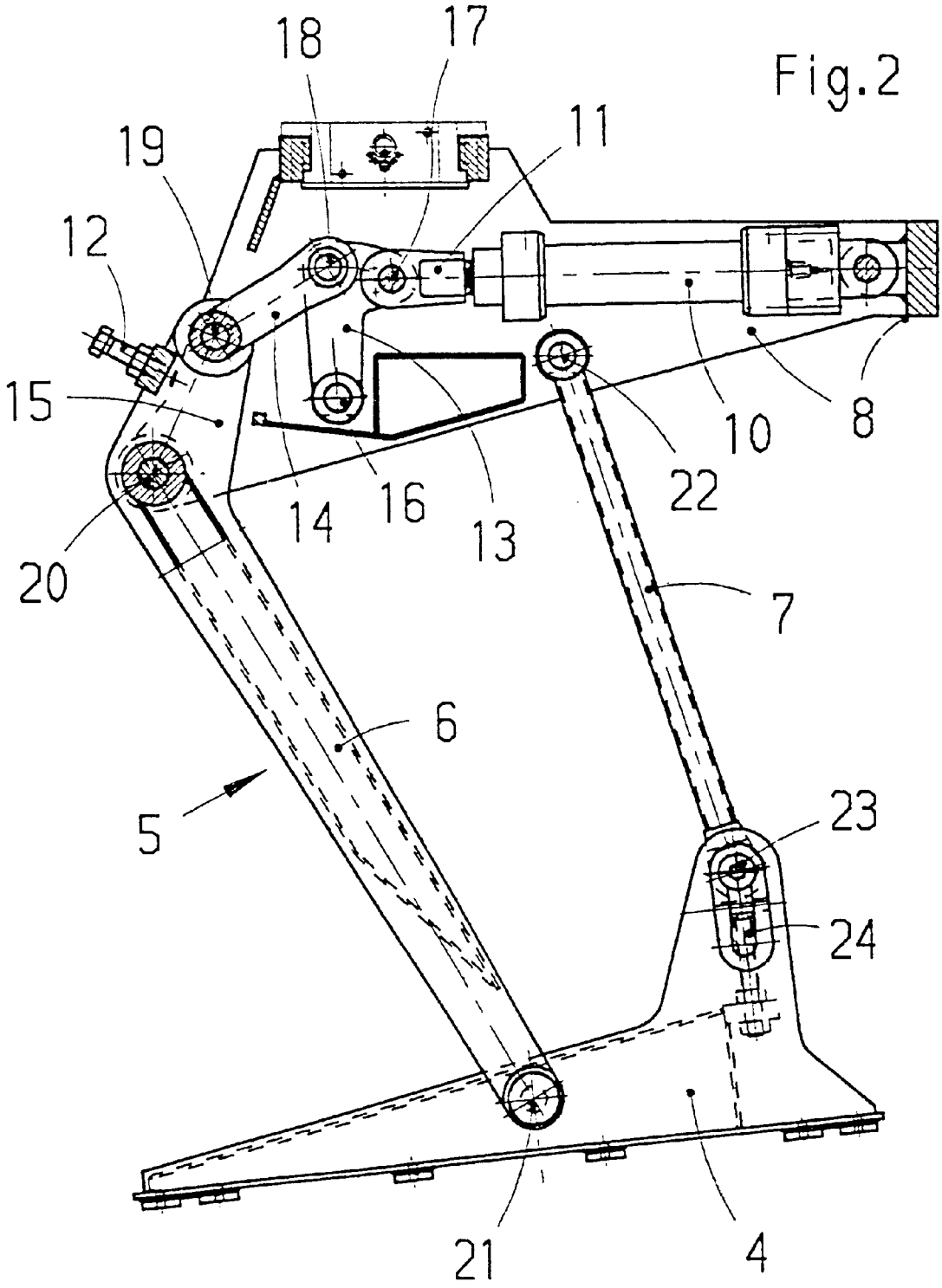
FIG. 2 shows in a side view and partially cutaway the lifting device separately in the boring position.

In FIG. 2 piston rod 11 of lifting cylinder 10 is retracted, so that carriage holder 4 with boring bar 3 not shown here is in an oblique boring position of for example 6 degrees here. The lowest location of this boring position can be limited or corrected by stop 12 which pushes against lifting frame 8 in the boring position.

The force of lifting cylinder 10 which is supported by the weight of the lifting device when moved into the boring position after initial pressurization, the bottom-side hydraulic oil needing to flow out essentially only in a controlled manner (choked), is transferred by piston rod 11 via angle lever 13 and link plate 14 to upper short lever arm 15 of two-arm lifting arm 6. Angle lever 13 is supported to pivot around axis 16 located stationary on lifting frame 8 and is joined to piston rod 11 via joint 17 and to link plate 14 via joint 18. Link plate 14 is connected via joint 19 to short lever arm 15 of lifting arm 6 which is pivoted around axis 20 which is located stationary on lifting frame 8 and its long lever arm is joined to swivel with carriage holder 4 via joint 21.

Connecting rod 7 of four-bar linkage 5 is pivoted around joint 22 on lifting frame 8 and is connected to carriage holder 4 via joint 23 which is positioned to be adjusted and fixed in bent slot hole rocker 24.

Figure 3:
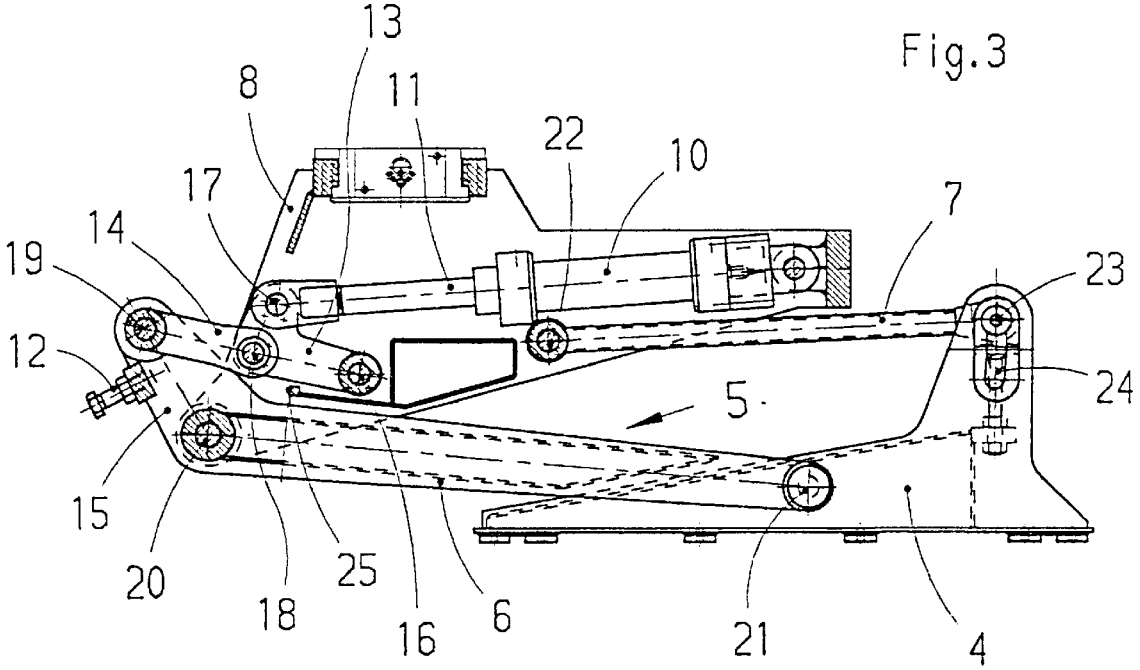
FIG. 3 shows this lifting device in the neutral position.

To move the lifting device into the neutral position shown in FIG. 3, lifting cylinder 10 is pressurized on the bottom-side, so that as a result of the specially selected lengths of the parts of four-bar linkage 5 and the location of the axes and joints 16–23 carriage holder 4 always assumes a horizontal position, regardless of the boring angle which is set with joint 23 in bent slot rocker 24 and which is roughly 6° in the representation of FIG. 2. If the boring angle is increased by shifting joint 23 in slot rocker 24 to the bottom, nothing changes on the horizontal neutral position as shown in FIG. 3, as can be easily seen since slot rocker 24 has a curvature with a center of curvature in the neutral position of carriage holder 4 which coincides with the axis of joint 22. The neutral position is limited by the stroke of lifting cylinder 10. Nevertheless, there is a safety stop 25 stationary on lifting frame 8.

In the neutral position of the lifting device, joints 16, 18, 19 lie with their axes almost on a line with a slight bend in joint 18 above and beyond the straight line, so that it assumes, like a knee link, a blocking position which keeps the entire lifting device securely in its neutral position. Stop 25 is hardly loaded here, even if lifting cylinder 10 were to be dismounted in this position.

FIGS. 2 and 3 moreover indicate that in this arrangement the lifting speed out of the boring position (FIG. 2) is initially high so that boring bar 3 (FIG. 1) very quickly comes out of the runner and tends toward zero in the direction to the neutral position (FIG. 3), so that this neutral position can be reached without jerking, with the initially mentioned advantages for the extension arm and the pivot mounting of the tapping hole boring machine.

This first embodiment described using FIGS. 2 and 3 can only be used where there is enough free space between the uppermost boring position and the neutral position. If this is not the case and the free space to the top is limited, for example, by a gallery or in some other way, the second embodiment shown in FIGS. 4 and 5 can be used, in which the same parts have the same reference numbers as in FIGS. 2 and 3.

Figure 4:
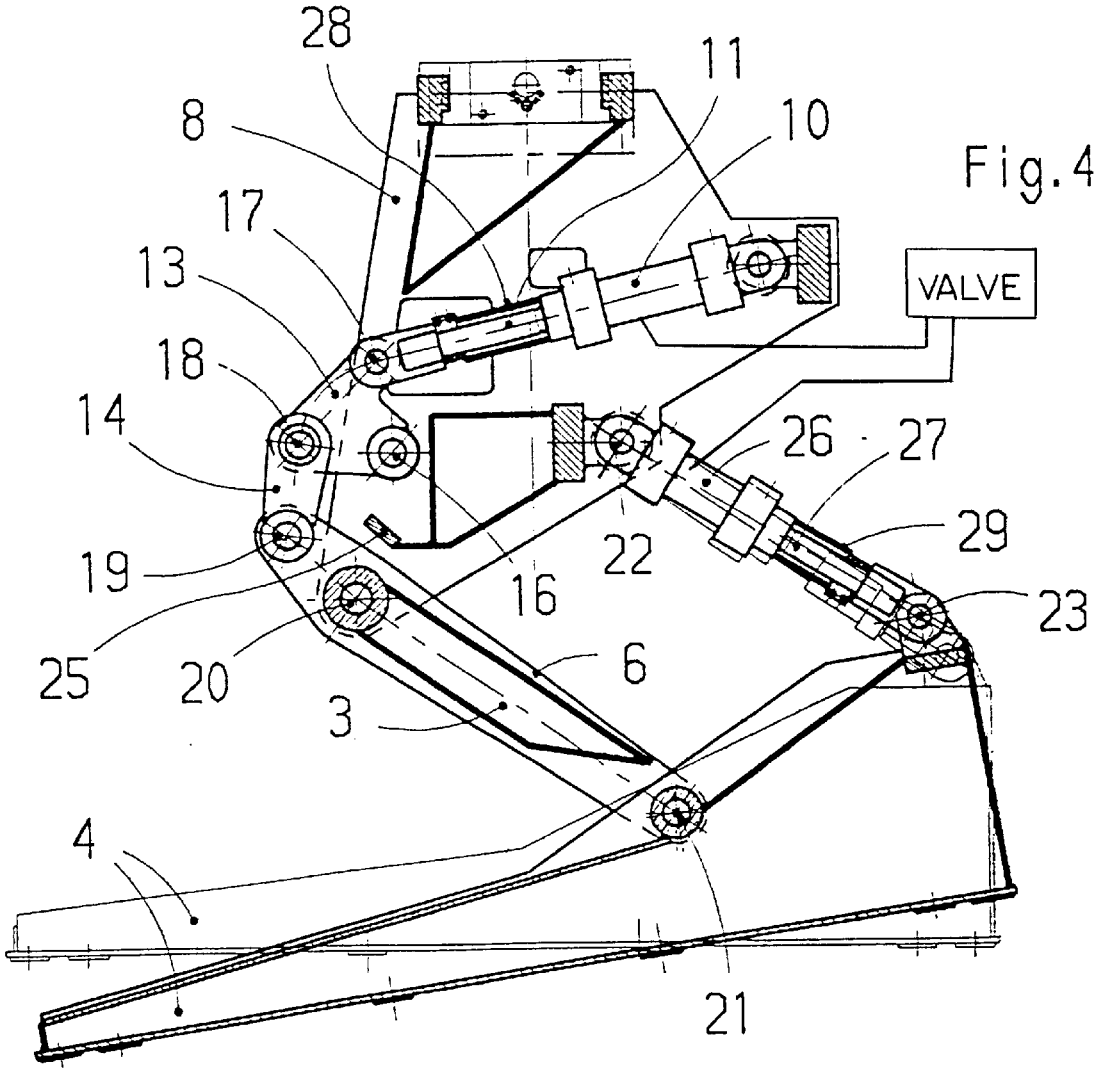
FIG. 4 shows in a side view separately and partially cutaway the lifting device of an second embodiment in the boring position and FIG. 5 shows this second embodiment in the neutral position.

The major differences compared to the first embodiment of FIGS. 2 and 3 are shorter lifting arm 6 and tilt cylinder 26 instead of connecting rod 7. FIG. 4 shows the lifting device in the boring position, carriage holder 4 being shown in thick lines. For both cylinders 10 and 26 only a single directional valve is necessary, the bottom sides of cylinders 10, 26 and the piston rod sides thereof each being hydraulically connected in parallel. This saves not only a valve, but also lines, since these valves are located away from the lifting device for safety reasons.

For upwards motion of the lifting device from the working position as per FIG. 4 two cylinders 10, 26 are equally pressurized at the same time on the bottom side in order to extend elongated piston rod 11 of lifting cylinder 10 and elongated piston rod 27 of tilt cylinder 26. The weight distribution of carriage holder 4 and boring carriage 1 and the kinematics of the lifting device first move carriage holder 4 into the horizontal position shown in FIG. 4 by phantom lines, since the center of gravity of carriage holder 4, carriage 1, boring bar 3 and boring machine 2 is to the right of joint 21 and therefore favors the extension of piston rod 27 of tilt cylinder 26. This tilting motion of carriage holder 4 takes place very quickly so that boring bar 3 is also moved out very quickly from the liquid metal jet with its front end. Immediately thereafter the hydraulic pressure in lifting cylinder 10 takes effect so that its piston rod 11 is extended and thus the lifting device is moved into the neutral position shown in FIG. 5.

In the working position of carriage holder 4 shown in FIG. 4, stroke limiting sleeve 28 which surrounds piston rod 11 adjoins lifting cylinder 10. Stroke limiting sleeve 28 can be adjusted with a thread on elongated piston rod 11 for fixing the lower end position of the lifting device in the boring position. The oblique position of carriage holder 4 or the boring angle is set on stroke limiting sleeve 29 which can be adjusted as in lifting cylinder 10 on piston rod 27 of tilt cylinder 26 by means of a thread.

Figure 5:
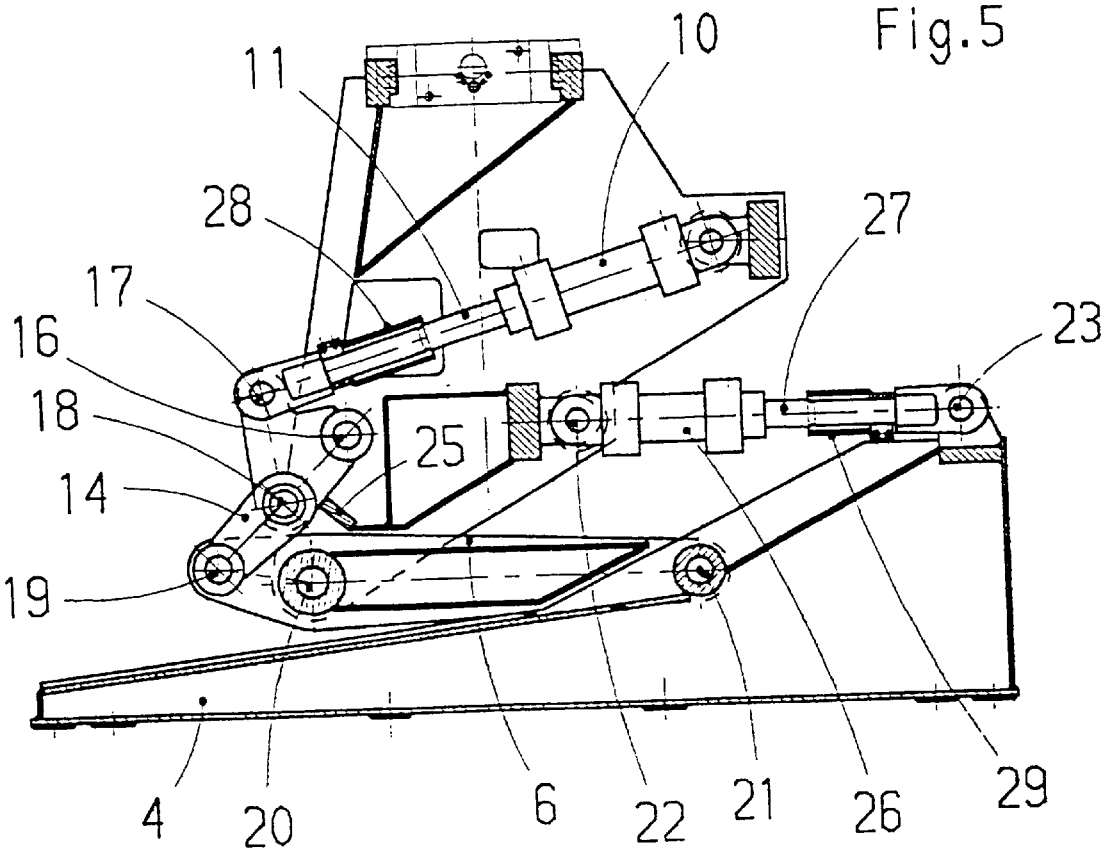

Since cylinders 10 and 26 are also hydraulically connected in parallel, movement out of the neutral position as per FIG. 5 into the final working or boring position as per FIG. 4 takes place as follows: As FIG. 5 shows, in the neutral position joint 18 between joints 16 and 19 as in the first embodiment first forms a self-locking knee link again, so that in this second embodiment as well the lifting device is securely held in the neutral position and also the initially fast upwards speed towards the neutral position tends toward zero in order to ensure soft arrival in the neutral position. To lower the lifting device the annular surfaces of two cylinders 10 and 26 are equally pressurized at the same time via the aforementioned common directional valve. In doing so first the blocking action of joint 18 is cancelled, not much force being necessary. The weight of the entire boring device "helps" when piston 11 of lifting cylinder 10 is being retracted until stroke limiting sleeve 28 again pushes against cylinder 10 (FIG. 4). Only then does the pressure rise on the annular surface of piston 27 of cylinder 26 (against the force of gravity as a result of the center of gravity moved to the right of joint 21) in order to move carriage holder 4 into the oblique position according to the desired boring angle.

The desired motion sequences can also be influenced by chokes (not shown) which are built into the hydraulic line system for cylinders 10, 26.

We claim:

1. Lifting device for tapping hole boring machines, in which a carriage holder can be swung up via a four-bar linkage by means of a lifting cylinder out of an obliquely sloped first working position having a angle which is adjustable on a connecting element of the four-bar linkage, into a second neutral position, the lifting cylinder including a piston rod and being linked to a free end of an angle lever which is pivoted around a first axis located stationary on a lifting frame, said angle lever being hinged via a link plate to an upper short lever arm of a two-arm lifting arm which is pivoted around a second axis located stationary on the lifting frame, the link plate with the short lever arm and the angled lever in the neutral position of the carriage holder forming a self-locking knee link.

2. Lifting device according to claim 1, wherein the connecting element is a connecting rod having two joints.

3. Lifting device according to claim 2, wherein to adjust the angle one of the joints of the connecting rod is adjustable on an arc with a center of curvature which coincides with the axis of the other joint of the connecting rod at the time, when the carriage holder is in the neutral position.

4. Lifting device according to claim 3, wherein one of the joints of the connecting rod is guided to be adjusted and fixed in an elongated slot rocker of the carriage holder.

5. Lifting device according to claim 4, wherein the elongated slot rocker of the carriage holder has a radius of curvature with a center in the neutral position of the carriage holder which coincides with the axis of the other joint of the connecting rod, said other joint being attached to the lifting frame.

6. Lifting device according to claim 1, wherein the connecting element is a tilt cylinder having a piston rod and a stroke which is limited by an adjustable stop to set the angle.

7. Lifting device according to claim 6, further comprising a directional valve for proper actuation of the lifting cylinder and of the tilt cylinder.

8. Lifting device according to claim 6, further comprising a stroke limiting sleeve which is adjustable via a thread each on the piston rod of the lifting cylinder, and also on the piston rod of the tilt cylinder to fix the working position of the carriage holder.

9. Lifting device according to claim 1, further comprising in the vicinity of the knee link, a safety stop which is active in the neutral position.

* * * * *